US007967526B2

(12) United States Patent
Aguilera Galeote

(10) Patent No.: US 7,967,526 B2
(45) Date of Patent: Jun. 28, 2011

(54) DEVICE REDUCING SPEED OF VEHICLES TRAVELLING ON A ROADWAY

(76) Inventor: Jose Antonio Aguilera Galeote, Malaga (ES)

( * ) Notice: Subject to any disclaimer, the term of this patent is extended or adjusted under 35 U.S.C. 154(b) by 0 days.

(21) Appl. No.: 12/666,045

(22) PCT Filed: Apr. 23, 2008

(86) PCT No.: PCT/ES2008/070077
§ 371 (c)(1),
(2), (4) Date: Dec. 22, 2009

(87) PCT Pub. No.: WO2009/007489
PCT Pub. Date: Jan. 15, 2009

(65) Prior Publication Data

US 2010/0202830 A1 Aug. 12, 2010

(30) Foreign Application Priority Data

Jul. 6, 2007 (ES) ..... 200701910
Feb. 26, 2008 (ES) ..... 200800527

(51) Int. Cl.
*E01F 9/047* (2006.01)

(52) U.S. Cl. ..... 404/15

(58) Field of Classification Search ..... 404/15
See application file for complete search history.

(56) References Cited

U.S. PATENT DOCUMENTS

| | | | | |
|---|---|---|---|---|
| 3,389,677 | A * | 6/1968 | Dunne | 116/205 |
| 3,720,181 | A * | 3/1973 | Elkins | 116/63 P |
| 4,362,424 | A | 12/1982 | Barber | |
| 6,024,510 | A * | 2/2000 | Kamienchick | 404/15 |
| 6,659,682 | B2 * | 12/2003 | Heeks | 404/15 |
| 2002/0085881 | A1 * | 7/2002 | Heeks | 404/15 |
| 2003/0143023 | A1 * | 7/2003 | Heeks et al. | 404/10 |
| 2009/0285630 | A1 * | 11/2009 | Miller | 404/9 |

FOREIGN PATENT DOCUMENTS

| | | | |
|---|---|---|---|
| EP | 0370154 | A1 | 5/1990 |
| GB | 2266552 | A | 11/1993 |
| GB | 2288419 | A | 10/1995 |
| GB | 2328235 | A | 2/1999 |
| GB | 2 403 758 | * | 1/2005 |
| JP | 2005330733 | A | 12/2005 |

* cited by examiner

*Primary Examiner* — Gary S Hartmann
(74) *Attorney, Agent, or Firm* — Brown & Michaels, PC

(57) ABSTRACT

The invention relates to a device reducing speed of vehicles travelling on a roadway, formed by at least one strip of flexible material, rubber or other similar material, made up of several hollow chambers which are interconnected by a calibrated conduit which enables the controlled passage of the fluid filling said chambers from that flattened by the wheel of the vehicle towards the adjacent chamber. The fluid contained therein is water, or a non-Newtonian fluid offering the higher viscosity, the higher the stress gradient applied thereto is, the fluid itself acting as means for controlling the resistance to deformation of the strip as the higher is the speed of impact of the vehicle in said strip.

7 Claims, 2 Drawing Sheets

DEVICE REDUCING SPEED OF VEHICLES TRAVELLING ON A ROADWAY

OBJECT OF THE INVENTION

As indicated by its title, the present invention relates to a device formed by several parallel strips, made up of projections located transversely on the roadway, oriented towards the vehicle movement direction, such that upon having to pass over them it obliges reducing the travelling speed in the area, to a certain extent.

BACKGROUND OF THE INVENTION

There are currently devices of these characteristics formed by strips with highlighted paint, setts, or simply rigid strips of plastic or rubber which are fixed to the ground. These elements form a rigid projection which must be passed over with all the wheels of the vehicle causing a double bounce or jump in the interior, which is considerably uncomfortable for the users.

Document GB-2288419 describes a deformable hollow strip made of a flexible material, which is filled with pressurized air, such that the vehicles run over an element that is not as hard or as aggressive for the tires.

Document JP2005330733 relates to a strip of rubber which has an inner void in which there is a fluid and a series of inner members like wings or partitions defining chambers, which are arranged with a location such that they are capable of absorbing sound impact and ground vibration when a vehicle passes over this strip; all of this is due to the elastic deformation of said members and the subsequent compression of the effects of the absorption of the inner fluid. The final purpose of this device is not to reduce its capacity of impact or resistance depending on the speed of the vehicles when they pass over it, but rather as indicated in its abstract, to reduce the noise and the vibration when this circumstance occurs.

Strips forming a variable obstacle depending on the speed of the vehicle in the moment of contacting with them are not known. The ideal situation is that if the vehicle travels at a very low speed, the obstacle partially disappears to facilitate its passage without this characteristic bounce or jump; whereas if the vehicle exceeds the advisable minimum speed the obstacle would be maintained at the highest level, such that when the vehicle impacts against this strip and when overriding it suffers the considerable jump alerting the driver of the risk he/she takes when travelling at a speed higher than the allowed speed.

DESCRIPTION OF THE INVENTION

The object of the device of the invention is a strip which works in a different manner than conventional strips and thus, as has been described in the previous section, when the vehicle travels at a speed lower than the recommendable speed it is deformed and the level is lowered when the wheels are placed on it, whereas if the vehicle enters into the area at a speed higher than the allowed or advisable speed, there is no time to adapt and deform it downwards and as a result it offers all its height to the wheels, causing a jump as when passing over a conventional strip.

This strip is made of a flexible material, rubber or other similar material, and is made up of hollow aligned chambers or chambers abutted at the sides, which are filled with a fluid and interconnected by a calibrated conduit which enables the controlled passage of the fluid of the chamber on which each wheel of the vehicle is located towards the adjacent chambers.

Thus, if the vehicle travels at a reduced speed as the wheels pass over the strip, fluid is moved to the adjacent chambers and a depression of the strip occurs in the area in which the wheels pass over, forming a small obstacle to the passage of the vehicle; nevertheless, if the speed of the vehicle is high, the fluid has no time to pass to the chambers adjacent to those which the wheels pass over and a considerably smaller depression occurs, thereby the strip forms a step with greater height, causing the vehicle to jump, warning of the excess speed.

The fluid used to fill this device is of the type of those called non-Newtonian fluids, which have characteristics and behavior clearly giving advantages to traditional fluids when subjected to different pressures.

A non-Newtonian fluid is that fluid the viscosity of which varies with the pressure gradient applied thereto. As a result, a non-Newtonian fluid does not have a defined and constant viscosity value, unlike a Newtonian fluid. Therefore, these fluids can be better characterized by means of other rheological properties, properties connected to the relationship between the stress and strains under different flow conditions, such as shear or oscillating stress conditions. A non-Newtonian fluid subjected for example to an impact of a teaspoon makes the fluid behave in a manner that is more similar to a solid than to a liquid, however if the same teaspoon is slowly pressed on the non-Newtonian fluid its behavior seems more similar to a liquid than to a solid since its viscosity has considerably decreased.

Therefore, the non-Newtonian fluid itself acts as means for controlling the resistance offered by the strip to its deformation depending on the speed of impact of the wheels of the vehicle on it. Thus, if the vehicle travels at a low speed the fluid has a low viscosity and the strip is easily deformed, whereas if the speed of the vehicle is high the viscosity of the fluid is high and as a result has great resistance to deformation, thus forming a rigid obstacle to the passage of the vehicle.

However, the fluid which fills the chambers of each of the strips forming the device can also be water, or even pressurized air. In both cases the material used in the manufacture of the strip is rubber, preferably coming from vehicle tire recycling.

Particularly when non-Newtonian fluids are not applied, each strip has to be compartmented in at least three aligned chambers interconnected by orifices with a diameter calibrated depending on the speed limit which is desired to be established in the area. There could also be several independent elements, provided at the sides with a conduit calibrated depending on the speed limit which is desired to be established in the area and a coupling means abutting with one another.

Each of these strips, whether it is a single body compartmented in several chambers or several laterally abutting attached elements, is optionally complemented by both sides, or at least by the side closest to the edge of the roadway, with a deposit which forms an expansion element complementary to the side chamber in those cases in which the vehicle is located on top of it.

DESCRIPTION OF THE DRAWINGS

To complement the description which is being made and for the purpose of aiding to better understand the features of the invention, a set of drawings is attached to this specification, in which the following has been depicted with an illustrative and non-limiting character.

PREFERRED EMBODIMENT OF THE INVENTION

Figure 1:
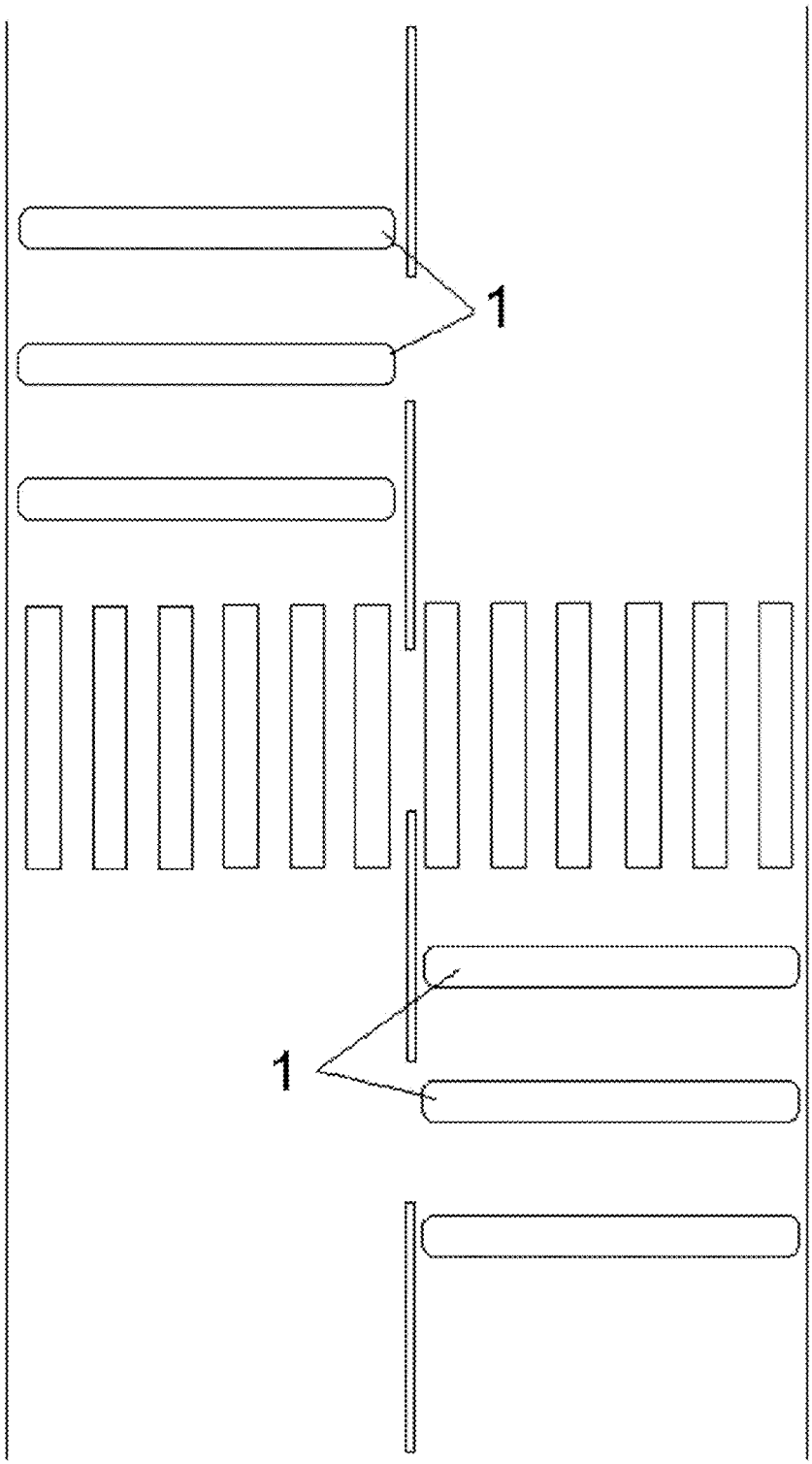
FIG. 1 shows an aerial view of a roadway in which this device has been placed around a crosswalk.

As can be observed in FIG. 1, this device is placed forming one or several parallel strips (1), made up of projections located transversely on the roadway, oriented towards the vehicle movement direction, such that upon having to pass over them it obliges attenuating the travelling speed on the roadway.

Figure 2:
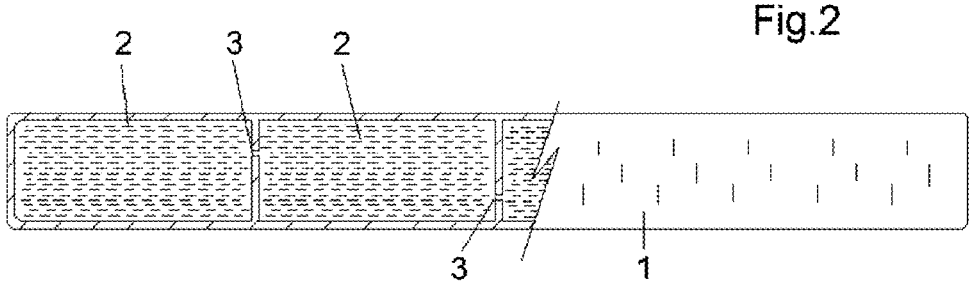
FIGS. 2 and 3 respectively depict partially sectioned plan and elevational views of one of the strips forming this device.
Figure 3:
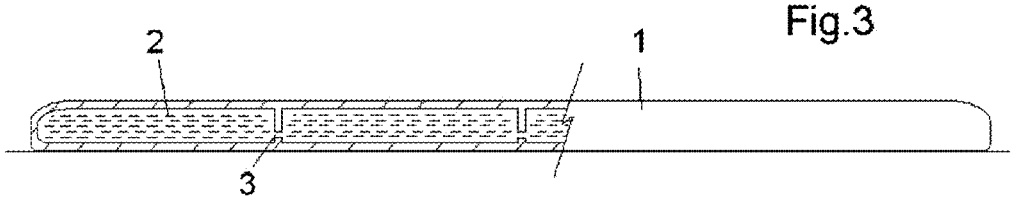

As is seen in FIGS. 2 and 3, each of these strips (1) is divided into several chambers (2) which are aligned, separated by an intermediate partition in which there is at least one calibrated interconnection conduit (3).

These chambers are can be filled with water or pressurized air such that when the wheel (5) of any vehicle runs on any area of the strip (1) it causes a flattening of the corresponding chamber (2) and the transfer of the fluid existing therein to the neighboring chambers. Given that the conduit (3) is calibrated, if the vehicle travels at a very low speed the amount of fluid transferred is large and as a result a great flattening of the strip (1) occurs, as is observed in FIG. 4. But if the vehicle travels at a speed higher than that calculated, the fluid of the chamber which the wheel (5) passes over has no time to be transferred to the neighboring chambers, thereby the strip (1) offers a great obstacle causing a jump in the wheels of the vehicle, as is observed in FIG. 5.

However, it could be seen that if these chambers are filled with a non-Newtonian fluid, which offers higher viscosity the higher the stress gradient applied thereto is, the fluid itself acts as means for controlling the resistance offered by the strip to its deformation depending on the speed of the impact, so that if the vehicle travels at a low speed the fluid has a low viscosity and the strip is easily deformed, whereas if the speed of the vehicle is higher the viscosity of the fluid is high and as a result has great resistance to deformation, thus forming a rigid obstacle to the passage of the vehicle. Thus, if the vehicle travels at a very low speed the density of the fluid is low and as a result the strip (1) is easily deformed, barely hindering its passage over it, whereas if the vehicle impacts at a high speed, the fluid offers a high viscosity thereby the strip offers great resistance to deformation and behaves as a difficult obstacle to pass over. The non-Newtonian fluids used in this device are of the type called "dilatants", among which are concentrated solutions of starch or of sugars in water and wet sand, all of which have a behavior in which, from a certain value, the relationship between the stress or speed of the stress and the viscosity is linear and increasing, an increase of the viscosity being caused depending on the shear stress gradient, which in summary in this application translates into the speed of the impact.

Figure 4:
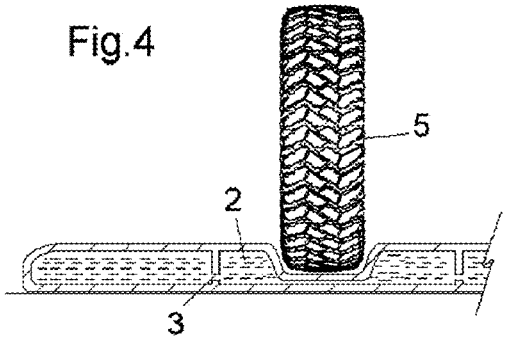
FIGS. 4 and 5 show elevational views of a strip in the moment in which a wheel is located on it, respectively when it travels at a very low speed and at a speed higher than the recommendable speed.
Figure 5:
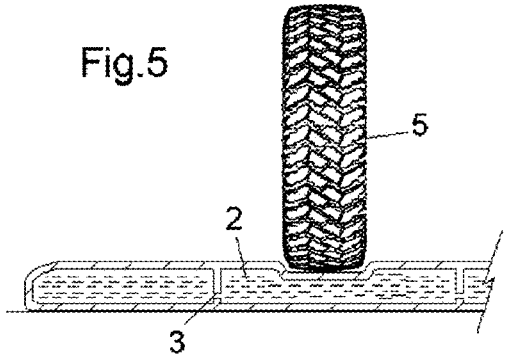
Figure 6:
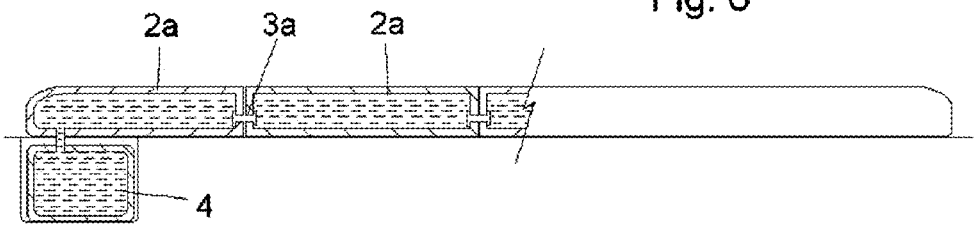
FIG. 6 depicts a partially sectioned elevational view of a strip formed by the attachment of several sections or elements (2*a*) and provided with a side expansion deposit (4).

This strip (1) can be a single piece, as has been depicted in FIGS. 2-4, or can be independent chambers (2*a*), which are attached to one another, abutted and forming an elongated strip, this attachment having a calibrated conduit (3*a*) through which the fluid passes from one to the other, working in the same way as that described in the previous paragraph (See FIG. 6).

The option of assembling an expansion deposit (4), connected to the side chambers which serve for relief thereof when the vehicle passes with one of its wheels next to the edge of the strip has also been provided. This expansion deposit is preferably buried in the ground of the roadway or on the curb.

Having sufficiently described the nature of the invention, as well as a preferred embodiment, it is stated for the relevant purposes that the materials, shape, size and arrangement of the described elements can be modified, provided that this does not involve an alteration of the essential features of the invention which are claimed below:

The invention claimed is:

1. A device for reducing speed of a vehicle travelling on a roadway, comprising a strip made of a flexible material, having a plurality of hollow fluid-filled chambers interconnected by a calibrated conduit for controlled passage of fluid from a chamber on which a wheel of the vehicle is located to at least one other chamber, the fluid which fills the plurality of chambers being a non-Newtonian fluid having a viscosity which varies proportional to a stress gradient applied thereto, such that a resistance offered by the strip to deformation by the wheel of the vehicle varies depending on the speed of impact, so that if the vehicle travels at a low speed the fluid has a lower viscosity and the strip has a lower resistance to deformation, and as the speed of the vehicle increases the viscosity of the fluid is higher, increasing resistance to deformation, thus forming a more rigid obstacle to the passage of the vehicle.

2. The device according to claim 1, in which the non-Newtonian fluid comprises wet sand.

3. The device according to claim 1, in which the non-Newtonian fluid comprises a solution of starch in water.

4. The device according to claim 1, in which the calibrated conduit comprises at least one orifice having a diameter selected based on a desired speed limit.

5. The device according to claim 1, in which the plurality of chambers comprise at least three independent elements, and the calibrated conduit is calibrated selected based on a desired speed limit.

6. The device according to claim 1, further comprising at least one expansion deposit connected to at least one chamber, located on a side closest to the edge of the roadway, forming an expansion element complementary to the at least one chamber, for relief of pressure therein when the vehicle passes over the chamber.

7. The device according to claim 1, in which the non-Newtonian fluid comprises a solution of sugar in water.

* * * * *